US005817991A

United States Patent [19]

Suyama et al.

[11] Patent Number: 5,817,991

[45] Date of Patent: Oct. 6, 1998

[54] CONNECTING STRUCTURE FOR CONNECTING HOLDING BRACKET TO MUFFLER

[75] Inventors: Eizo Suyama, Tokyo, Japan; Katsuyuki Okada, Bedlington, United Kingdom; Yoichi Takahashi, Kanagawa, Japan

[73] Assignee: Calsonic Corporation, Tokyo, Japan

[21] Appl. No.: 815,365

[22] Filed: Mar. 11, 1997

[30] Foreign Application Priority Data

Mar. 11, 1996 [JP] Japan ..... 8-053212

[51] Int. Cl.[6] ..... F01N 7/18; B60K 13/04

[52] U.S. Cl. ..... 181/243; 180/296

[58] Field of Search ..... 181/243, 282; 180/296, 309; 248/610

[56] References Cited

U.S. PATENT DOCUMENTS

| | | | |
|---|---|---|---|
| 1,890,151 | 12/1932 | Hadley | 181/282 |
| 2,081,546 | 5/1937 | McPherson | 181/243 |
| 2,160,808 | 6/1939 | Bradley | 181/243 |
| 2,744,706 | 5/1956 | Gerdy | 181/243 |
| 3,746,127 | 7/1973 | Leventhal | 181/243 |
| 4,494,722 | 1/1985 | Kanai et al. | 248/621 |

FOREIGN PATENT DOCUMENTS

| | | |
|---|---|---|
| 2-286818 | 11/1990 | Japan . |
| 7-293234 | 11/1995 | Japan . |

*Primary Examiner*—Khanh Dang
*Attorney, Agent, or Firm*—Foley & Lardner

[57] ABSTRACT

To connect a holding bracket to a muffler, an improved connecting structure therebetween is proposed. The muffler includes a tubular case and two end plates which are connected to axially open ends of the tubular case by means of caulking thereby to form around each axially end of the case a caulked raised portion. The bracket includes a metal rod and a metal plate. The metal plate includes an upper gripping part which grips the caulked raised portion and a lower gripping part which grips the metal rod. The metal plate has between the upper and lower gripping parts an intermediate wall portion which is put on the metal rod, so that when the muffler is properly held by the supporting bracket, entire weight of the muffler is substantially supported by the metal rod.

9 Claims, 4 Drawing Sheets

CONNECTING STRUCTURE FOR CONNECTING HOLDING BRACKET TO MUFFLER

BACKGROUND OF THE INVENTION

1. Field of the Invention

The present invention relates in general to holding brackets for holding a muffler to a vehicle body, and more particularly to connecting structures for connecting or fixing the holding bracket to the muffler.

2. Description of the Prior Art

In motor vehicles, holding brackets are commonly employed for holding a muffler to a vehicle body. In this connection, various connecting structures for connecting the holding bracket to the muffler have been proposed and put into practical use.

In order to clarify the task of the present invention, one conventional connecting structure for that connection will be described with reference to FIG. 5 of the accompanying drawings, which is disclosed in Japanese Patent First Provisional Publication 7-293234.

In FIG. 5, denoted by numeral 11 is a cylindrical muffler which is suspended from a floor panel of an associated motor vehicle (not shown). The muffler 11 comprises a cylindrical case 12 which installs therein essential parts (not shown) of the muffler 11 and two end plates 13 (only one is shown) which close axially open ends of the cylindrical case 12. As is understood from the drawing, for securing the end plates 13 to the axially open ends of the case 12, a so-called "caulking" technique is used wherein the edge of the plate 13 and that of the case 12 are jointed by interlocking folds. With the caulking, a caulked raised portion 15 is integrally formed around each axial end of the cylindrical muffler 11.

Denoted by numeral 16 is a holding bracket for holding the muffler 11 to the floor panel of the vehicle. The holding bracket 16 comprises a metal rod 19 which extends transversely above the muffler 11 and a pressed metal plate 17 which extends between the rod 19 and the caulked raised portion 15. Although not shown in the drawing, a shock absorbing mechanism is operatively arranged between the rod 19 and the floor panel of the vehicle. The positional relationship between the holding bracket 16 and the muffler 11 may be easily understood when reference is made to FIG. 1.

Referring back to FIG. 5, a lower part 17*a* of the pressed metal plate 17 is press-held between the caulked raised portion 15 and an outer surface of the muffler 11, while, an upper part 17*b* of the pressed metal plate 17 is connected to the rod 19 by gripping the same. The upper part 17*b* has a generally U-shaped cross section for the gripping connection with the rod 19.

However, due to its inherent construction, the above-mentioned conventional connecting structure for connecting the holding bracket 16 to the muffler 11 has the following drawback.

That is, after long use, it tends to occur that the connection between the caulked raised portion 15 of the muffler 11 and the pressed metal plate 17 of the holding bracket 16 becomes loose. That is, after long use, the caulked raised portion 15 tends to rise from the muffler 11 causing lowering of gripping force applied to the metal plate 17 from the caulked raised portion 15. This rising phenomenon is much severe when the weight of the muffler 11 is great and the case 12 and the end plates 13 are constructed of thin metal plates. Of course, if the looseness becomes marked, the muffler 11 is disengaged from the holding bracket 16.

SUMMARY OF THE INVENTION

It is therefore an object of the present invention to provide a connecting structure for connecting a holding bracket to a muffler, which is free of the above-mentioned drawback.

According to the present invention, there is provided a connection structure through which a holding bracket is tightly connected to a muffler without usage of welding.

According to the present invention, there is provided a combination which comprises a muffler including a tubular case and two end plates which are connected to axially open ends of the tubular case by means of caulking thereby to form around each end of the case a caulked raised portion; and a holding bracket including a metal rod and a metal plate, the metal plate including an upper gripping part which grips the caulked raised portion and a lower gripping part which grips the metal rod, wherein the metal plate has between the upper and lower gripping parts an intermediate wall portion which is put on the metal rod, so that when the muffler is properly held by the holding bracket, entire weight of the muffler is substantially supported by the metal rod.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
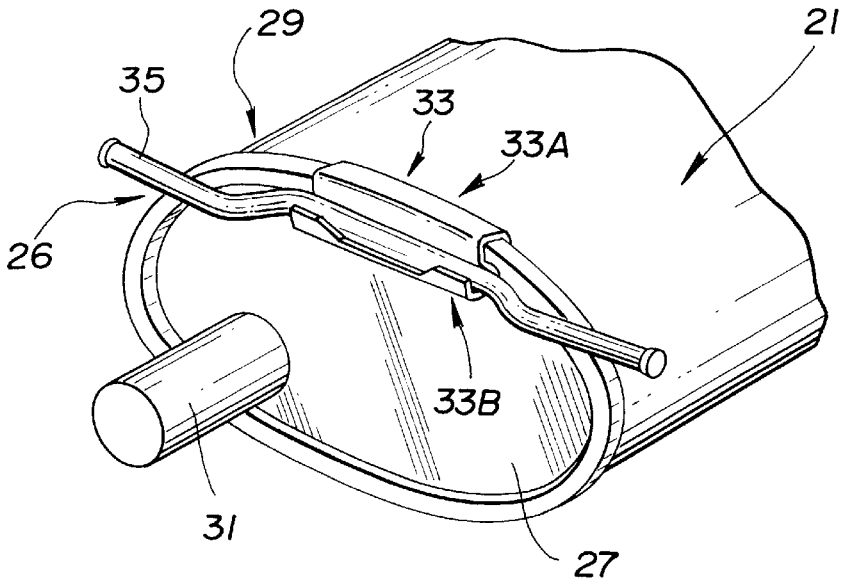
FIG. 1 is a perspective view of a connecting structure of a first embodiment of the invention, through which a holding bracket and a muffler are connected.
Figure 2:
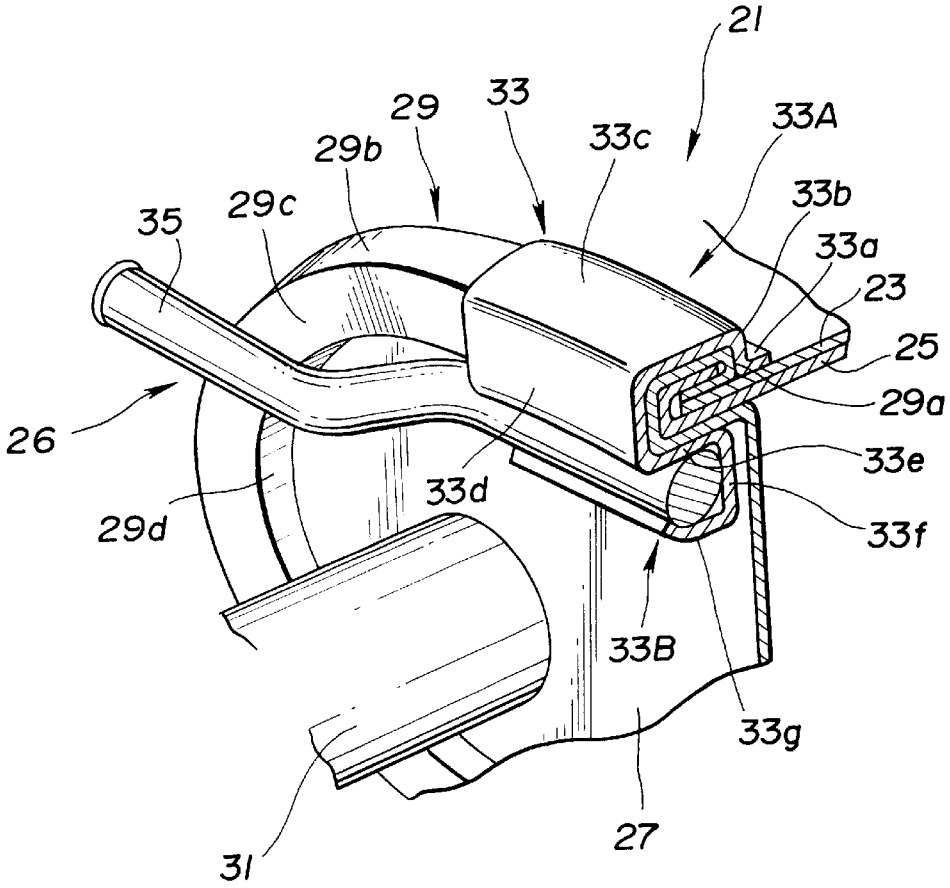
FIG. 2 is an enlarged, but partially cut, perspective view of the connecting structure of the first embodiment.

Referring to FIGS. 1 and 2, particularly FIG. 1, there is shown a connecting structure of a first embodiment of the present invention, through which a muffler 21 and a holding bracket 26 are tightly connected.

As shown, the muffler 21 has an oval cross section and comprises an elliptic cylindrical case (23+25) which installs therein essential parts of the muffler 21 and two oval end plates 27 (only one is shown) which close axially open ends of the case (23+25). Each end plate 27 is constructed of a stainless steel plate having a thickness of about 0.6 mm to 1.0 mm. If desired, each oval end plate 27 has a double layered structure including two thin plates each having a thickness of about 0.3 mm to 0.5 mm. As is seen from FIG. 2, the elliptic cylindrical case (23+25) has a double layered structure including an outer shell 23 and an inner shell 25. Each shell 23 or 25 is constructed of a stainless steel plate having a thickness of about 0.3 mm to 0.5 mm.

For securing the end plates 27 to the axially open ends of the case (23+25), "caulking" technique is used, and thus, the muffler 21 has a caulked raised portion 29 which is integrally formed around each axial end of the muffler 21, as is understood from FIG. 1. As shown, the caulked raised portion 29 has an entire part projecting axially outwardly by a certain degree from the end plate 27. Each end plate 27 has an exhaust pipe 31 welded thereto. That is, exhaust gas from an engine (not shown) is led into the muffler 21 through for example the illustrated pipe 31 and discharged to the open air through the other pipe (not shown). During this, noise possessed by the exhaust gas is reduced or damped by the muffler 21.

As is seen from FIG. 1, the holding bracket 26 is constructed to hold the caulked raised portion 29 of the muffler 21. The holding bracket 26 comprises a metal rod 35 which extends transversely near the caulked raised portion 29 of the muffler 21 and a pressed metal plate 33 which extends between the rod 35 and the caulked raised portion 29. The metal plate 33 is constructed of a stainless steel having a thickness of about 1 to 2 mm. In practical use, a shock absorbing mechanism (not shown) is arranged between the rod 35 and the floor panel of the vehicle.

As is best shown in FIG. 2, the pressed metal plate 33 comprises an upper gripping part 33A which tightly grips the caulked raised portion 29 of the muffler 21 and a lower gripping part 33B which tightly grips a depressed middle portion of the rod 35. As shown, the depressed middle portion of the rod 35 is positioned just below the upper part of the caulked raised portion 29 of the muffler 21. For assuring the gripping, the metal plate 33 has a generally S-shaped cross section.

The upper gripping part 33A comprises a flange portion 33*a*, an inside wall portion 33*b*, an upper wall portion 33*c*, an outside wall portion 33*d* and an intermediate wall portion 33*e* which are arranged to tightly grip the caulked raised portion 29 of the muffler 21 through caulking technique. That is, as shown, the flange portion 33*a* is intimately put on the outer wall of the muffler 21, the inside wall portion 33*b* is pressed against an inside wall part 29*a* of the caulked raised portion 29, the upper wall portion 33*c* is pressed against an upper wall part 29*b* of the caulked raised portion 29, the outside wall portion 33*d* is pressed against an outside wall part 29*c* of the caulked raised portion 29 and the intermediate wall portion 33*e* is pressed against a lower wall part 29*d* of the caulked raised portion 29.

The lower gripping part 33B comprises the above-mentioned intermediate wall portion 33*e*, a vertical wall portion 33*f* and a lower wall portion 33*g* which are arranged to tightly grip the depressed middle portion of the rod 35 through caulking technique. That is, the intermediate wall portion 33*e* is pressed against an upper part of the rod 35, the vertical wall portion 33*f* is pressed against an inside part of the rod 35 and the lower wall portion 33*g* is pressed against a lower part of the rod 35.

With the above-mentioned connecting structure defined between the muffler 21 and the holding bracket 26, the following advantages are obtained.

First, the above-mentioned undesired loosed connection between the caulked raised portion 29 of the muffler and the holding bracket 26 hardly occurs due to inherent construction of the connecting structure. That is, as is understood from FIG. 2, entire weight of the muffler 21 is substantially held by the rod 35 not by the metal plate 33. Thus, even after long use, the tight connection between the caulked raised portion 29 and the holding bracket 26 is assuredly maintained. For the same reason, the case (23+25) and the end plates 27 of the muffler 21 can be constructed of a relatively thin metal plate, which induces reduction in production cost of the muffler.

Second, since the caulked raised portion 29 of the muffler 21 is entirely gripped and enclosed by the upper gripping part 33A of the metal plate 33, the same is reinforced. Thus, undesired bending of the caulked raised portion 29, which would be caused by the weight of the muffler 21, is suppressed or at least minimized.

Third, due to provision of the flange portion 33*a* of the metal plate 33, undesired rising movement of the caulked raised portion 29 is suppressed or at least minimized.

Fourth, since the connection between the holding bracket 26 and the muffler 21 is achieved without usage of welding, the case (23+25) and the end plates 27 of the muffler 21 can be made of a relatively thin metal plate. In fact, welding to thin metal plates is very difficult because it may cause production of openings in the thin metal plates.

Figure 3:
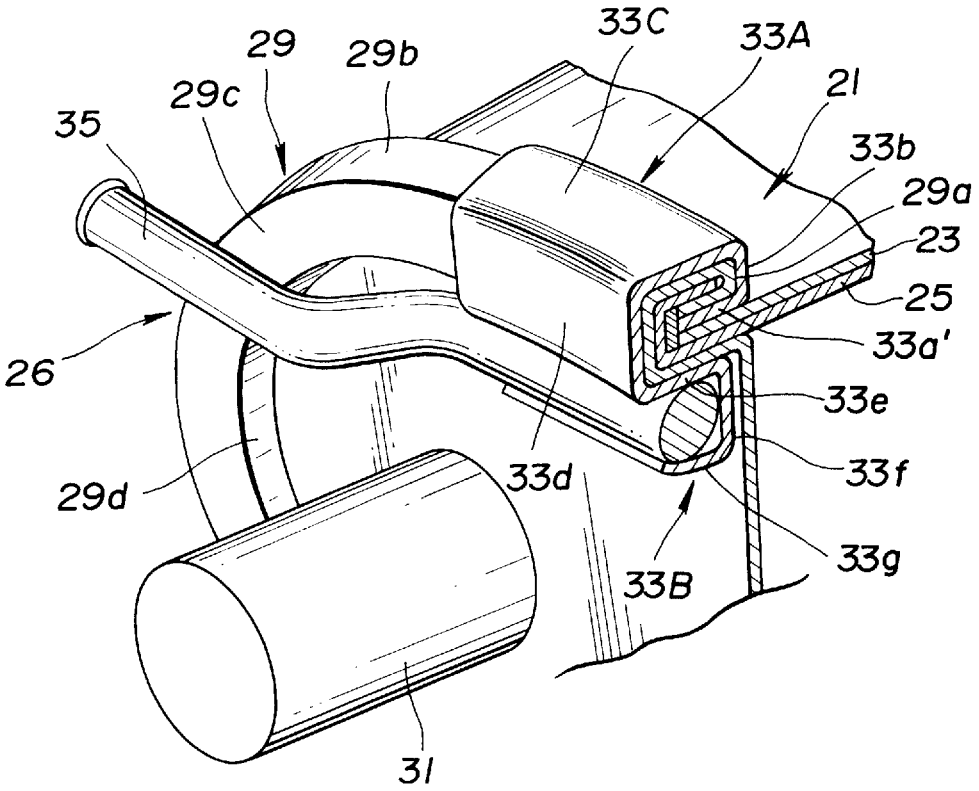
FIG. 3 is a view similar to FIG. 2, but showing a connecting structure of a second embodiment of the present invention.

Referring to FIG. 3, there is shown a connecting structure of a second embodiment of the present invention, through which a muffler 21 and a holding bracket 26 are tightly connected.

Since the connecting structure of this second embodiment is similar to that of the above-mentioned first embodiment, only portions which are different from those of the first embodiment will be described in detail in the following. Parts substantially the same as those of the first embodiment will be denoted by the same numerals.

That is, in the second embodiment, a modification is provided between the upper gripping part 33A of the pressed metal plate 33 and the caulked raised portion 29 of the muffler 21. As shown in the drawing, a flange portion 33*a'* extending from the inside wall portion 33*b* of the upper gripping part 33A is intimately held by the caulked raised portion 29. That is, the flange portion 33*a'* is press-held between the caulked raised portion 29 and the outer surface of the muffler 21.

Figure 4A:
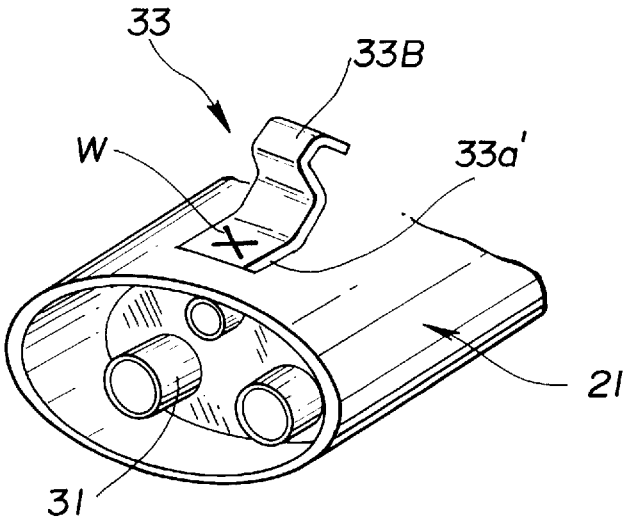
FIGS. 4A, 4B and 4C are schematic views showing the steps for joining a holding bracket to a caulked raised portion formed around an axial end of the muffler, in case of the second embodiment.
Figure 4B:
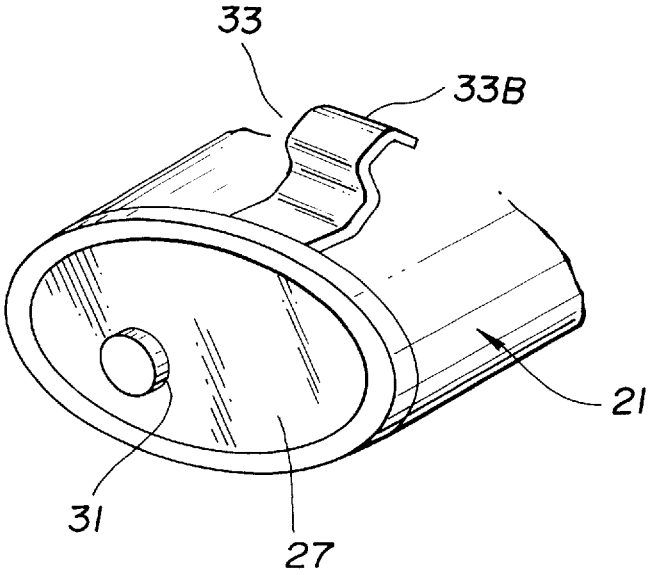
Figure 4C:
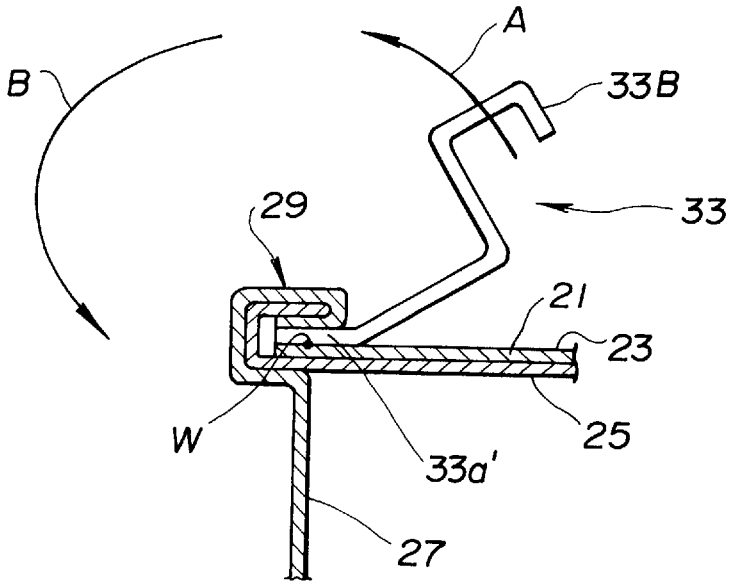
Figure 5:
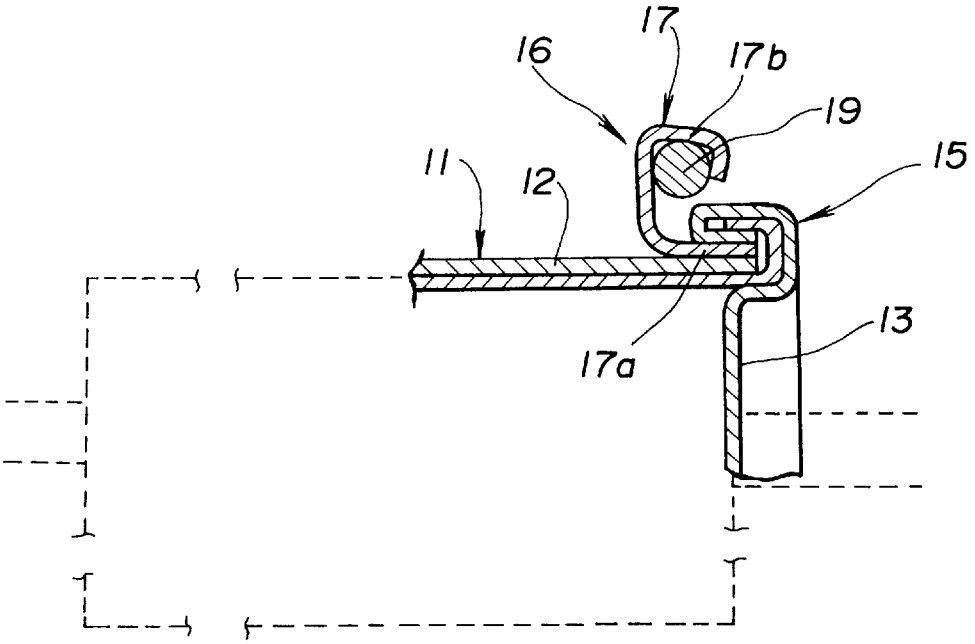
FIG.5 (PRIOR ART)
FIG. 5 is a partial sectional view of a conventional connecting structure through which a holding bracket and a muffler are connected.

FIGS. 4A, 4B and 4B show schematically the steps for joining the pressed metal plate 33 to the caulked raised portion 29. That is, as is seen from FIG. 4A, one end portion of the pressed metal plate 33 is welded at "W" to an axial end portion of the case (23+25), then as is seen from FIG. 4B, the end plate 27 is put on the open end of the case (23+25) having a peripheral end portion thereof put on the welded end portion of the metal plate 33. Then, the layered end portion of the case (23+25) is caulked to enfold the welded end portion of the metal plate 33 therein. Then, as is seen from FIG. 4C, the other end portion of the metal plate 33 which will constitute the lower gripping part 33B is pulled up and the metal plate 33 is intimately wound around the caulked raised portion 29 in a manner as shown by the arrows "A" and "B". After completion of these steps, the lower gripping part 33B is caulked to grip the rod 35, as is understood from FIG. 3.

In this second embodiment, substantially same advantages as those of the first embodiment are obtained. In addition, in the second embodiment, the connection between the metal plate 33 and the caulked raised portion 29 is much assured.

What is claimed is:

1. A combination comprising:

a muffler including a tubular case and two end plates which are connected to axially open ends of said tubular case by means of caulking thereby to form around each end of the case a caulked raised portion; and a holding bracket including a metal rod and a metal plate, said metal plate including an upper gripping part which grips said caulked raised portion and a lower gripping part which grips said metal rod, wherein said metal plate has between said upper and lower gripping parts an intermediate wall portion which is put on said metal rod, so that when said muffler is properly held by said holding bracket, the weight of said muffler is substantially supported by only said metal rod relieving said metal plate from supporting said weight.

2. A combination as claimed in claim 1, in which said metal rod extends transversely in front of one of the end plates, with which said holding bracket is incorporated.

3. A combination as claimed in claim 2, in which said metal rod includes a depressed middle portion which is positioned just below an axially outwardly extending part of an upper portion of said caused raised portion, so that the intermediate wall portion of said metal plate is intimately disposed between the axially outwardly extending part of said caulked raised portion and the depressed middle portion of said metal rod.

4. A combination as claimed in claim 3, in which said upper gripping part, said intermediate wall portion and said lower gripping part of said metal plate are so combined as to allow said metal plate to have a generally S-shaped cross section.

5. A combination as claimed in claim 4, in which said lower gripping part of said metal plate comprises said intermediate wall portion which is pressed against an upper part of said metal rod, a vertical wall portion which is pressed against an inside part of said metal rod and a lower wall portion which is pressed against a lower part of said metal rod.

6. A combination as claimed in claim 5, in which said upper gripping part of said metal plate comprises an inside wall portion which is pressed against an inside wall part of the caulked raised portion, an upper wall portion which is pressed against an upper wall part of the caulked raised portion, an outside wall portion which is pressed against an outside wall part of the caulked raised portion and said intermediate wall portion which is pressed against a lower wall part of the caulked raised portion.

7. A combination as claimed in claim 6, in which said upper gripping part of said metal plate further comprises a flange portion which is intimately put on an outer wall of said muffler.

8. A combination as claimed in claim 6, in which said upper gripping part of said metal plate further comprises a flange portion which is press-held between the caulked raised portion of an outer surface of said muffler.

9. A combination as claimed in claim 1, in which said tubular case of the muffler has a double layered structure including outer and inner stainless steel shells, each having a thickness of approximately 0.3 mm to 0.5 mm, and in which each of the end plates is constructed of a stainless steel plate having a thickness of approximately 0.6 mm to 1.0 mm, and in which said metal plate is constructed of a pressed stainless steel having a thickness of approximately 1 mm to 2 mm.

* * * * *